US005711523A

United States Patent [19]

Sternberg et al.

[11] Patent Number: 5,711,523

[45] Date of Patent: Jan. 27, 1998

[54] PUZZLE GAME APPARATUS

[75] Inventors: Herbert M. Sternberg, William Island; Leonard S. Traub, Hollywood, both of Fla.

[73] Assignee: Herbko International, Inc., Hallandale, Fla.

[21] Appl. No.: 551,199

[22] Filed: Oct. 31, 1995

[51] Int. Cl.[6] ..... A63F 9/08

[52] U.S. Cl. ..... 273/153 R; 273/309; 434/426

[58] Field of Search ..... 273/153 R, 157 R, 273/309; 434/426, 365, 427, 428

[56] References Cited

U.S. PATENT DOCUMENTS

| | | | |
|---|---|---|---|
| 853,042 | 5/1907 | Thomson | 434/426 |
| 2,837,839 | 6/1958 | Fernbach | 434/426 |
| 3,991,498 | 11/1976 | Beach | 434/426 |
| 4,203,234 | 5/1980 | Thenon | 434/426 |
| 4,340,372 | 7/1982 | Brassine | 434/426 |
| 4,427,387 | 1/1984 | Tomita | 434/426 |
| 4,486,018 | 12/1984 | Keller, Jr. | 273/157 R |
| 4,761,139 | 8/1988 | Mashiach | 434/426 |
| 4,836,783 | 6/1989 | Harper | 434/426 |

*Primary Examiner*—Steven B. Wong
*Attorney, Agent, or Firm*—Robert M. Schwartz

[57] ABSTRACT

Apparatus in accordance with the invention comprises a lightweight puzzle game holder, easily held by a game player in one hand, and puzzle game sheets replaceably held in the holder. The holder comprises base and cover components. The cover is hinged to the base and opens and closes to permit loading of a replaceable puzzle game sheet, the latter containing a collection of multiple puzzle games printed on a writable medium such as paper. The cover contains a window dimensioned to frame a single puzzle game in the collection for viewing and solving by a game player. In solving the base player writes on the game. The base contains a platen opposite the cover window, the platen forming a hard backing surface facilitating writing by a game player. In one embodiment, the holder contains a storage compartment beneath the platen, for storing e.g. a pencil sharpener, pencils, etc. In another embodiment, the platen in the holder is translucent and the space beneath the platen contains a light, a battery and an on/off switch. When the light is energized, a puzzle game situated above the platen is clearly backlit enabling a player to solve the puzzle in a dark room (e.g. a bedroom). Each puzzle game refill sheet comes rolled up on a "feed" spool, the latter reusable as a "takeup" spool. The outer end of the sheet is secured to the remainder of the sheet by a piece of reusable tape. The tape is reused to secure the outer end of the sheet to a takeup spool, and instructions printed on the tape inform the game player of that use.

18 Claims, 6 Drawing Sheets

PUZZLE GAME APPARATUS

BACKGROUND OF THE INVENTION

1. Field of the Invention

This invention relates to puzzle game apparatus, and particularly to apparatus for holding collections of puzzle games—typically, collections of crossword puzzles or the like—in a manner facilitating viewing and solving of games in each collection by a game player or solver. The invention also relates to a particular form of packaging of puzzle game refill collections as an article of manufacture.

2. Problem Solved by the Invention

Traditionally, collections of puzzle games such as crossword puzzles have been published and sold to the public in non-durable media—e.g. magazines and paperback type books—that are not intended to be used over long periods of time (e.g. years), and are generally awkward to write upon without a firm backing surface such as a desk or clipboard. It is also generally difficult for a game player/user to locate a page containing a game previously left partially solved, without placing a bookmark or "dog ear" on that page.

The present invention seeks to overcome these disadvantages by providing holder apparatus for such game collections that is lightweight, durable for years of use, reusable to hold multiple game collections (one collection at a time), and handy and easy to use (in that the holder is easily held by a game player in one hand, provides a firm writing surface for the player, and leaves an unfinished game in a viewed position that makes it easy to resume solving).

In respect to reusability, the present holder apparatus is designed to enable a game player to easily discard a used game collection and replace it with a new refill collection. Thus, over years, the holder can be reused to play/solve many collections of puzzle games.

The invention also seeks to provide refill game collections per se, as articles of manufacture, in a form facilitating installation of a refill collection into the above holder apparatus as a replacement of a spent collection (e.g. one in which all of the puzzle games have been played).

SUMMARY OF THE INVENTION

In accordance with the invention, game holder apparatus—that is lightweight, durable and easy to hold and write on—consists of base and cover components, preferably composed of molded plastics. The cover latches to the base to form enclosures for holding "feed" and "takeup" spools. A sheet of writable material (typically, paper), that is initially wound upon the feed spool, is fed manually onto the takeup spool. The sheet contains a series of printed puzzle games (e.g. crossword puzzles) that are moved sequentially to a viewing/playing position in the holder apparatus and played/solved. As each game is played, the sheet is moved towards the takeup spool to present a next game for playing/solving. The foregoing sheet handling is analogous to the handling of film in a camera.

When all of the games on a sheet have been played, the cover can be opened, the "played out" sheet and the takeup spool on which it is wound may be discarded, the then empty feed spool can be moved to the position of the discarded takeup spool, and a refill sheet of games on a new feed spool can be installed in the position vacated by the empty feed spool and prepared for movement to the new takeup spool (old feed spool). Then, the cover can be closed and the games on the refill sheet can be successively viewed and played.

The cover contains a viewing opening, or window, through which the games are viewed and written upon for playing. The window is dimensioned to provide viewing/playing access to only one game at a time. Rotatable dial assemblies secured to the base are manually turned by a puzzle player to position successive puzzle games on a sheet for viewing and playing.

The base includes a platen that is framed by the cover. The platen forms a firm backing surface beneath the portion of the sheet that is accessible within the window opening of the cover, so that a user of the apparatus can easily and conveniently write on the respective portion to solve a game puzzle. The platen contains a pair of ridges forming a guiding channel that keeps the puzzle sheet properly aligned with the takeup spool to wind uniformly onto that spool as the games are played.

The holder apparatus is light in weight and can be either hand held or conveniently rested on a player's lap or other surface while games are being played.

Solutions to pairs of consecutive puzzles are printed on the puzzle sheet between the respective pair of puzzles. Although these solutions are not visible to the game player while any puzzle is being viewed and solved, they become visible as the dial assemblies on the holder are turned to bring the respective solutions into view. Thus, after a first puzzle on a sheet has been solved, the sheet can be advanced to display the solution of that puzzle, and after the next puzzle on the sheet is solved the sheet can be moved backwards to display the solution to that puzzle. This process can be repeated for successive pairs of puzzles on the sheet and their respective solutions.

The cover preferably is hinged to the base, and pivots to open and closed positions relative to the base. The cover is dimensioned so that when it is pivoted to the closed position, the edge of the cover that approaches the base slides snugly over a corresponding edge of the base. Near these overlapping edges, the cover and base contain nipples and indentations which interlock when the cover is fully closed (e.g. nipples on the cover and indentations on the base or vice versa). Thus, as it is closed, the overlapping edges of the cover and base snap forcibly into "keyed" engagement to keep the holder apparatus securely closed while games are being played and a game sheet is being moved.

The force securing this engagement is easily overcome by holding the base while lifting up the cover at its overlapping edge. Thus, the cover is easily opened to allow access to spools (e.g. for removal of a used game sheet and/or insertion of a new refill feed spool and preparation of a sheet on that spool for movement to a new takeup spool, etc.).

In one disclosed embodiment of the invention, the base contains a storage drawer located beneath the platen. This drawer slides in and out of the base to permit storage of objects used by a game player (e.g. pencils). The drawer also contains a pencil sharpener, and an opening communicating with that sharpener, so a pencil can be inserted into that opening and sharpened while the drawer is closed. The base is constructed to prevent the drawer from being fully removed from the base when it is opened.

In a second disclosed embodiment, the platen is translucent and the space beneath the platen contains a source of light and a battery. When a switch on the base is turned to an "on" position, the light is energized illuminating a puzzle currently framed in the cover window. Thus a game player can solve puzzles in bed at night without external light.

In accordance with the invention, sheets containing refill collections of new puzzle games are supplied tightly wound on feed spools and held in that configuration by pieces of reusable tape securing otherwise loose ends of respective sheets. When a refill sheet and spool are installed into present holder apparatus, the piece of tape is removed and used to attach the loose end of the respective sheet to an empty takeup spool; thereby preparing the sheet for movement from its feed spool to the takeup spool. Instructions marked on these pieces of tape indicate this reuse function to the game player/user.

These and other features, aspects and objectives of the invention will be more fully appreciated by considering the following description and claims.

DETAILED DESCRIPTION

Figure 1:
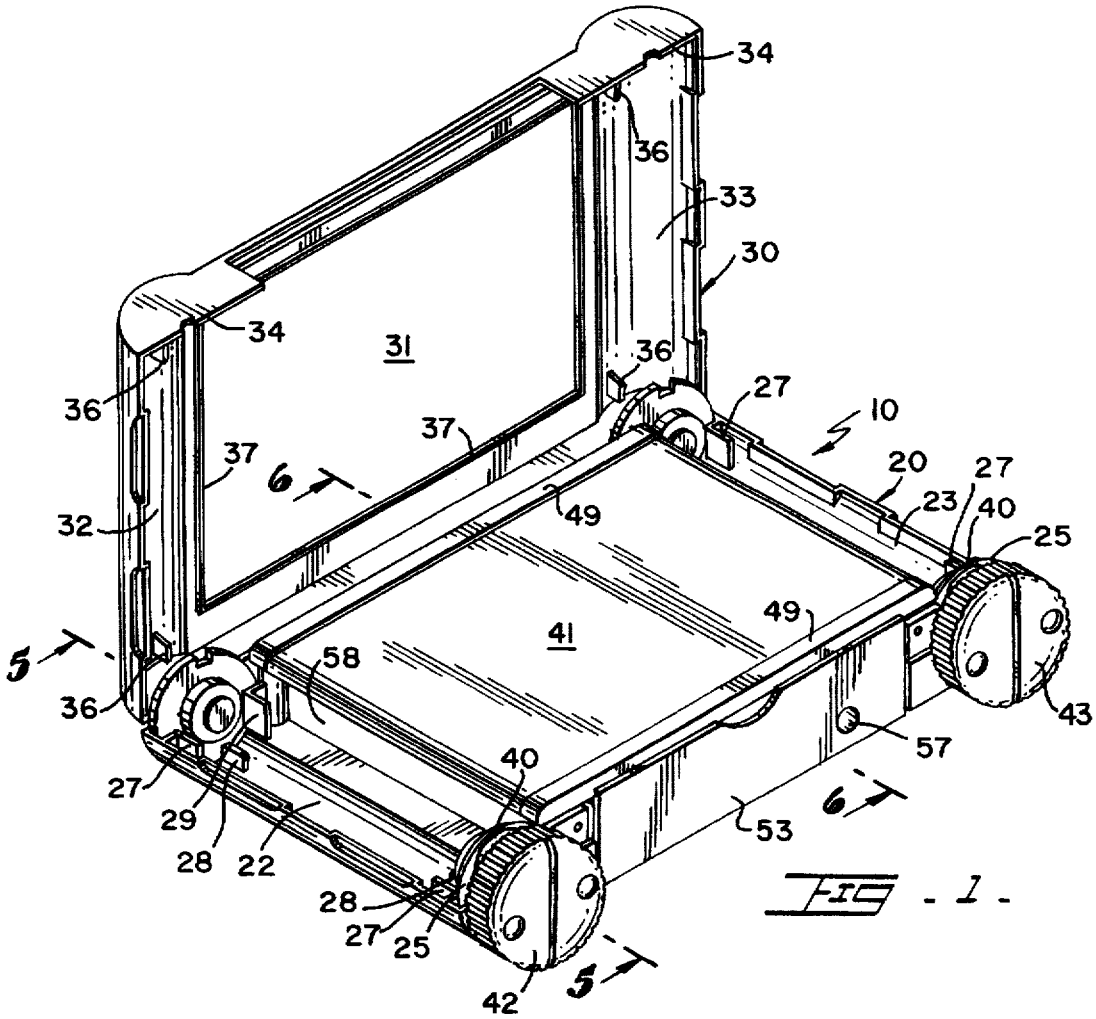
FIG. 1 is a perspective view of game holder apparatus in accordance with a first embodiment of the invention, shown in an empty condition (without a game sheet and spools) and with its cover open.

FIG. 1 is a perspective view of holder apparatus 10 which, in accordance with the invention, is lightweight, durable for years of potential use, easily held in one hand by a game player/solver and easily written upon. Holder apparatus 10 comprises base 20 and cover 30. Cover 30 is hinged to base 20, via plastic hinge 21 (FIG. 5), and shown in an open position in FIGS. 1 and 2. Components 20 and 30 are preferably formed of molded plastic parts. Base 20 preferably is an assembly of several parts described below.

When cover 30 is pivoted to a closed position against base 20, edge portions of the cover and base snugly overlap to form an enclosure for spools and a puzzle sheet. The overlapping edge portions of the cover and base have facing protrusions and indentations that interlock to secure the just-mentioned enclosure so that the cover does not accidentally open while the holder is being transported or used for game playing.

Cover 30 contains window opening 31, through which games are viewed and accessed to be written upon in the game playing process. Collections of games thus viewed and accessed are provided on a transportable sheet described later.

Base 20 contains a platen element 41 which faces window opening 31 in cover 30 when the cover is closed. Platen 41 forms a hard backing surface enabling a puzzle game player/solver to write upon the aforementioned not-shown sheet while holding the holder assembly in his/her hand or resting it on his/her lap.

When cover 30 is closed, rounded ends 22 and 23 in base 20, and 32 and 33 in cover 30, form "spool holding" compartments explained next. The compartment formed by ends 22 and 32 is termed the feed compartment, since it is used presently to hold a feed spool initially containing an unplayed sheet of puzzle games. The compartment formed by ends 23 and 33 is termed the takeup compartment since it is used to hold an initially empty takeup spool.

In use, cover 30 is opened, and a sheet containing a series/collection of multiple unplayed puzzle games solvable by writing (e.g. crossword puzzles) is installed in the feed compartment wound upon a feed spool. A loose end of the sheet is attached to an empty takeup spool in the takeup compartment, and the cover is closed against base 20. Then dial assemblies described below are manually manipulated to position successive games on the installed sheet for viewing in cover window 31. As each game is positioned in window 31 the apparatus user plays/solves the respective game by placing written entries on the sheet. During such entries, the sheet is held securely by elements of the cover and base, and platen 41 serves as a backing surface.

The feed and takeup spools have identical constructions and are useful interchangeably. Thus, when all of the games on a sheet have been played, and the sheet has been fully wound upon a takeup spool, the played sheet and takeup spool can be discarded, the empty feed spool can be moved to the takeup compartment, and a new refill game sheet and feed spool can be installed in the feed compartment.

Dials 42 and 43 (FIG. 1) are parts of associated dial assemblies that are used to transport a game sheet between the feed and takeup compartments. The dial assembly associated with dial 42 couples to the feed compartment and the dial assembly associated with dial 43 couples to the takeup compartment. These dials, and their associated dial assemblies, are identically constructed. The dials are manually turned by a game player and, when the feed and takeup compartments respectively contain feed and takeup spools, the respective dial assemblies engage and turn respective spools to transport a game sheet (bidirectionally) between the feed and takeup compartments.

Figure 5:
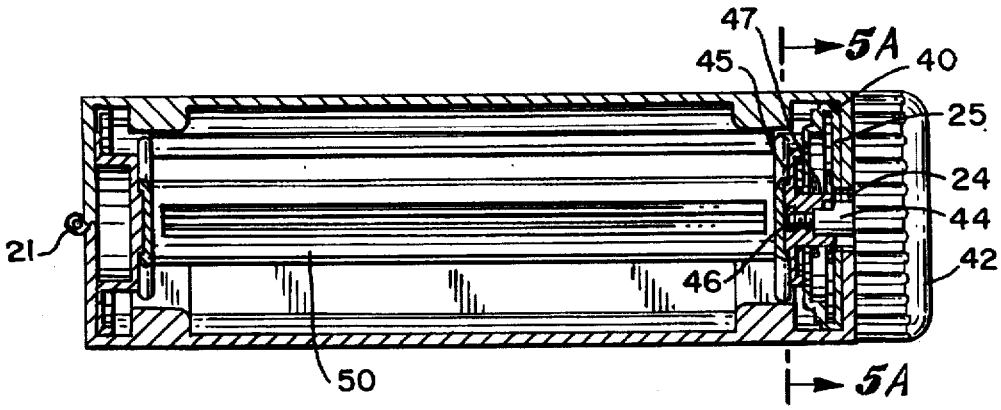
FIG. 5 is a sectional view through the holder apparatus shown in FIG. 1, for explaining details of construction of dial assemblies and spool holding compartments contained in that apparatus.
Figure 5A:
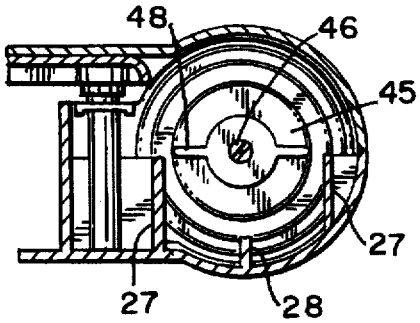
FIG. 5A is a sectional view transverse to that of FIG. 5 for further illustrating constructional details of a dial assembly seen in FIG. 5.
Figure 1B:
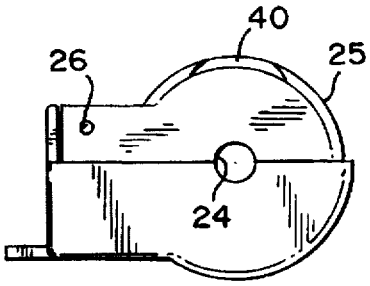

Constructional details of the dial assembly associated with a dial 42 are shown in FIGS. 5 and 5A. In addition to dial 42, this assembly includes a shaft 44, extending through an opening 24 in a rounded portion 25 of base 20, and an end plate 45 secured to the end of shaft 44 by screw 46. The assembly can be pulled away from the base by pulling on dial 42. However, spring 47, located between end plate 45 and rounded base portion 25, exerts a force on the end plate opposing such motion. Thus, when dial 42 is not being pulled away from the base, and a feed spool 50 is contained in feed compartment 22-32 (FIG. 5), projecting ridges 48 on end plate 45 (FIG. 5A) are biased into engagement with corresponding indentations 51 (FIG. 3) in the end of feed spool 50. Consequently, when dial 42 is rotated counterclockwise, feed spool 50 rotates in the same direction to wind a game sheet backwards onto that spool.

Since the feed and takeup dial assemblies and respective spools have identical constructions, it should be understood that the dial assembly associated with dial 43 has similar interaction with a takeup spool, when such a spool is contained in the takeup compartment. Therefore it is understood that when dial 43 is turned clockwise, a game sheet, extending between feed and takeup spools respectively held in the feed and takeup compartments, is moved towards and wound up on the takeup spool.

As noted previously, dials 42 and 43 can be pulled outwardly from the side of base 20, against the force of spring 47. This permits end plate 45 to be pulled outwardly towards the side of the base, to provide clearance for removing or inserting a feed spool.

When cover 30 is closed against base 20, edge portions 25 on the base, adjacent to the dial assemblies mentioned earlier, are overlapped and contacted by corresponding edge portions 34 on the cover (FIG. 1). The cover and base have almost equal dimensions so that cover edge portions 34 ordinarily would not extend over base edge portions 25. However, at surfaces where these edge portions meet, edge portions 25 are tapered, as shown at 40 in FIG. 1, to allow edge portions 34 to slide over edge portions 25 with slight tension, resulting in a snug fitting engagement between these edge portions. The taper of one of the edge portions 25 is indicated at 40 in FIG. 1.

Figure 1A:
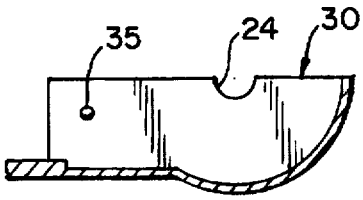
FIGS. 1*a* and 1*b* illustrate details of interlocking constructions of edge portions of cover and base components of the apparatus shown in FIG. 1.

In addition, as shown in FIG. 1*a*, edge portions 34 are provided with one or more nipple-like protrusions suggested at 35, and edge portions 25 are provided with one or more indentations suggested at 26. These protrusions and indentations are so positioned that when the cover is closed, each protrusion 35 interlocks with a respective indentation 26. This interlocking effect, together with the snug fitting tapered engagement noted above, ensure that the cover does not accidentally slip open or get jarred open while the holder is being used for playing games. To open the cover, a player needs to hold onto the base with one hand while pulling a non-overlapping edge of the cover (near the platen) firmly up with the other hand.

As will be shown later, a typical game sheet contains solutions to pairs of consecutively positioned games in a space between each respective pair of games. Thus, when a game sheet is moved towards the take-up spool, after a first game of a pair is played/solved, the solution to that game can be viewed by the user/game player; and when the sheet is moved backwards after the second game of a pair has been played, the solution to the second game can be viewed.

Continuing to refer to FIG. 1, each end of each spool holding compartment includes a set of inwardly projecting tabs 27, 28 and 29 on the base and a single inwardly projecting tab 36 on the cover. These tabs act as limiting stops, serving to prevent feed and takeup spools from rolling out of respective holding compartments when the dial assemblies are turned. Each set of tabs 26, 27 and 28 in each end and side of a base compartment 22 and 23 consist of three tabs; one extending from the bottom interior surface of the base tab 28 at the respective compartment end and the other two 26 and 28 positioned to either side of tab 28, one tab 27 more distal from platen 42 and the other tab 29 more proximal to platen 41. Each cover tab 36 extends from the top interior surface of the cover, at a respective compartment end, in alignment with the base tab 28 that extends from the bottom surface of the base at the respective compartment end.

Furthermore, inwardly extending ridges 37 on the cover, adjacent to the cover window opening 31, serve to press against a game sheet in play so that the latter can not shift while it is being written upon. Naturally, ridges 37 should be dimensioned so that they do not unduly hinder movement of the sheet when the dial assemblies are turned.

Figure 2:
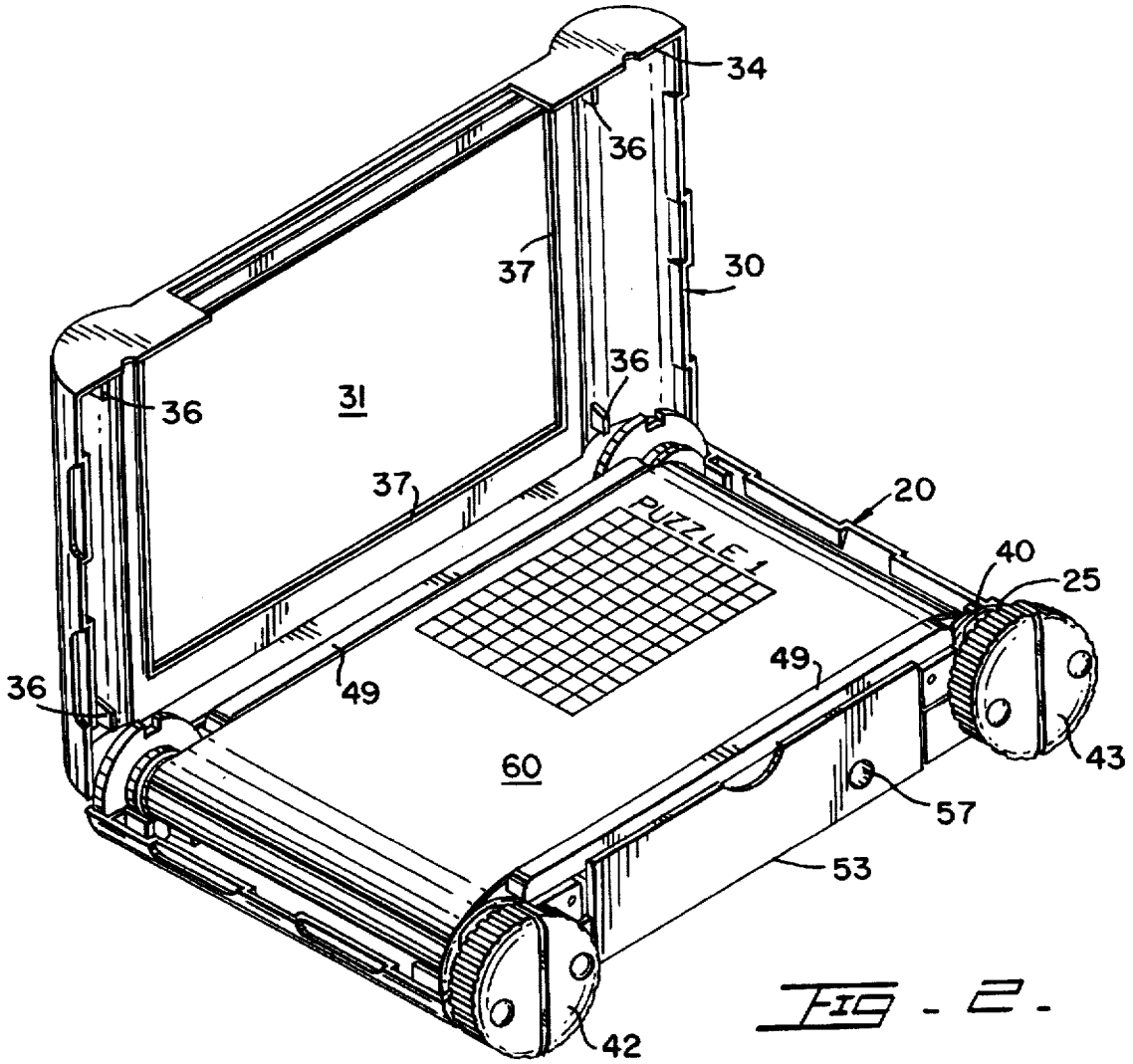
FIG. 2 is a perspective view of holder apparatus like that in FIG. 1 but in a filled condition, i.e. with a game sheet held on feed and takeup spools; and also showing the arrangement of a single puzzle game on the game sheet relative to a viewing window in the cover.

The base and cover are seen in FIG. 2 with a game sheet 60 loaded and positioned for play/solution of a first puzzle game labelled PUZZLE 1. A typical such puzzle game would be a conventional crossword puzzle (having "across" and "down" clues enabling a user to fill in discrete box spaces in the puzzle). A single puzzle game, together with all of its clues, is dimensioned to be completely viewable in cover window 31, when the sheet containing the game is appropriately positioned relative to window 31.

Figure 3:
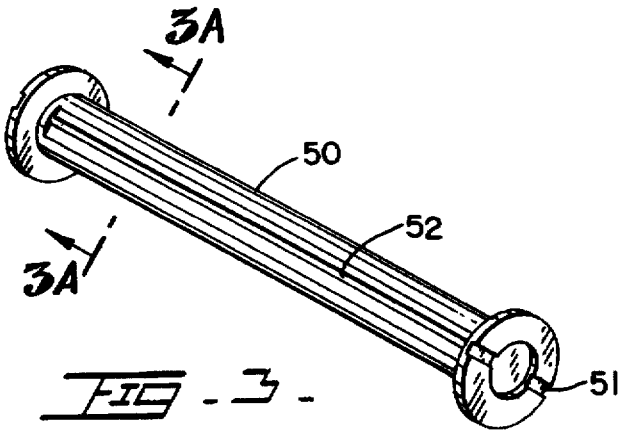
FIG. 3 is a perspective view of an empty spool, that can be used interchangeably as a feed spool or a takeup spool in accordance with the invention, and illustrating a constructional detail for explaining how the respective spool is engaged and rotated by a dial assembly on game holder apparatus like that shown in FIG. 1.
Figure 3A:
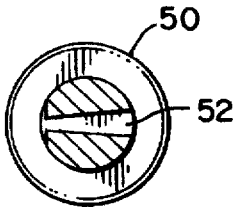
FIG. 3A is a sectional view through the spool of FIG. 3, showing a slot formation in the spool which is used to engage one end of a sheet of puzzle games.

Referring to FIGS. 3 and 3A, each spool 50 (feed and take-up) contains an opening 52. The opening 52 in a take-up spool is used to receive an end of a puzzle sheet nearest a first game to be played, and the opening 52 in a feed spool is used to hold an end of a puzzle sheet nearest a last game to be played. The puzzle sheet is supplied to the end user initially rolled up on a feed spool, and transported during play from that spool to the takeup spool (by manual rotation of dial 43 As noted previously, the spools are used interchangeably, so that as a game sheet is fully reeled onto a take-up spool, the sheet and that spool can be removed from end/takeup compartment 23-33 and discarded; and further so that the then empty feed spool can be moved from end/feed compartment 22-32 to compartment 23-33 and used as a take-up spool relative to a new feed spool and game sheet inserted into compartment 22-32.

Figure 4:
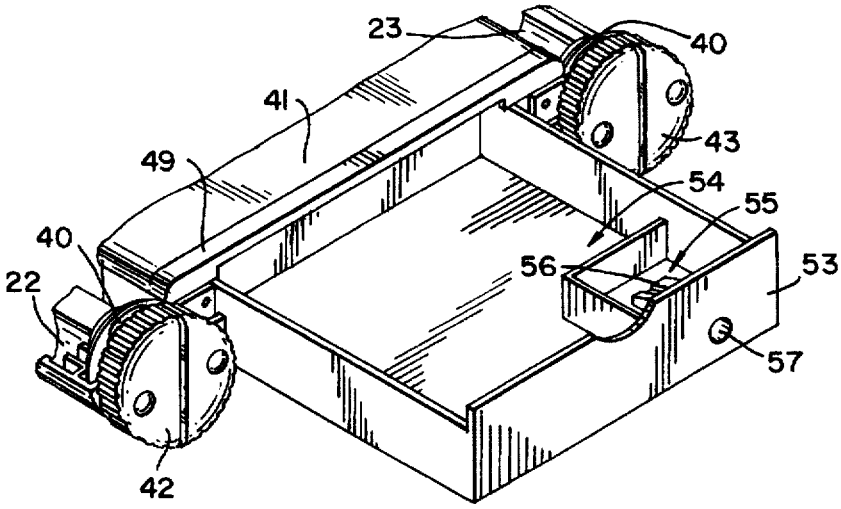
FIG. 4 is a perspective view of part of the holder apparatus shown in FIG. 1, for illustrating details of a storage drawer compartment provided in that apparatus.

Referring to FIG. 4, a drawer 53 is slidably retained in base 20 below platen 41. The drawer contains a storage compartment 54, for holding objects such as pencils, and a small compartment 55 holding a pencil sharpener 56 fixed to the inside bottom surface of that compartment. Opening 57 in the outer end of the drawer coincides with an opening in pencil sharpener 56, so that a pencil can be sharpened manually by inserting it into opening 57 and turning it.

Referring again to FIGS. 5 and 5A, end compartment 22-32 is shown containing a feed spool 50. End plate 45 (FIG. 5A) contains a projection 48 which keys into a corresponding indentation 51 (FIG. 3) at the end of the feed spool. Consequently, when dial 42 is turned the feed spool rotates. Similarly, when end compartment 23 (FIG. 1) contains a takeup spool, the end plate of the dial assembly containing dial 43 (FIG. 1) keys into that spool causing the latter to rotate when the dial is turned.

Figure 6:
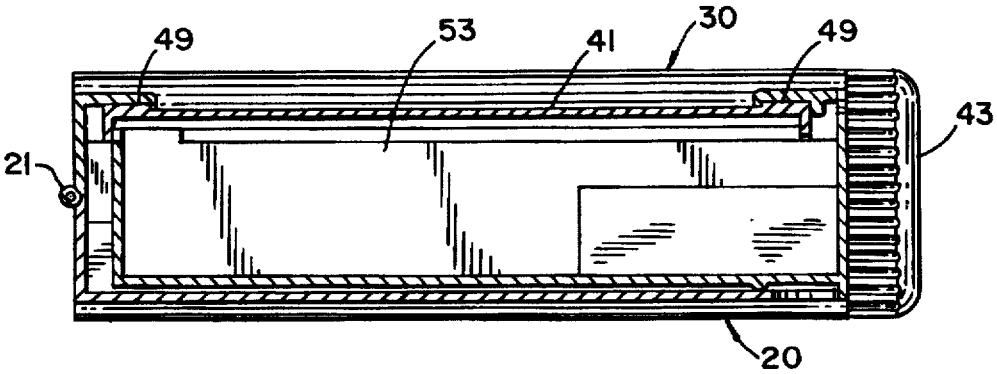
FIG. 6 is a sectional view through the holder apparatus of FIG. 1, showing constructional details of a platen element contained in that apparatus.

Referring to FIG. 6, elevated ridges 49 at ends of platen 41 (see also FIG. 1), serve as guiding elements relative to edges of a puzzle sheet while such sheet is transported between the feed and takeup end compartments.

Figure 8:
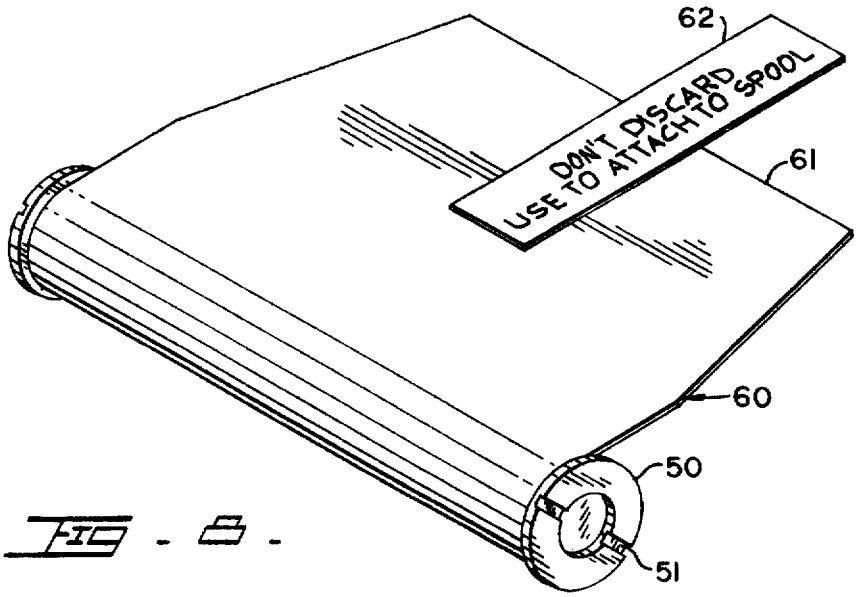
FIG. 8 is a view of a "refill" puzzle game sheet and feed spool as an article of manufacture supplied in accordance with the present invention.

FIG. 8 shows the construction of a refill game sheet 60 and feed spool 50 as supplied to an end user (game player). The end 61 of sheet 60, which is closest to a first game to be played, is initially held to the rolled up sheet on the spool by a piece of reusable tape 62. The tape carries printed indications instructing the user to use the tape to fasten the end 61 to a takeup spool (an empty one in the holder takeup compartment) to prepare the sheet for game playing.

Figure 9:
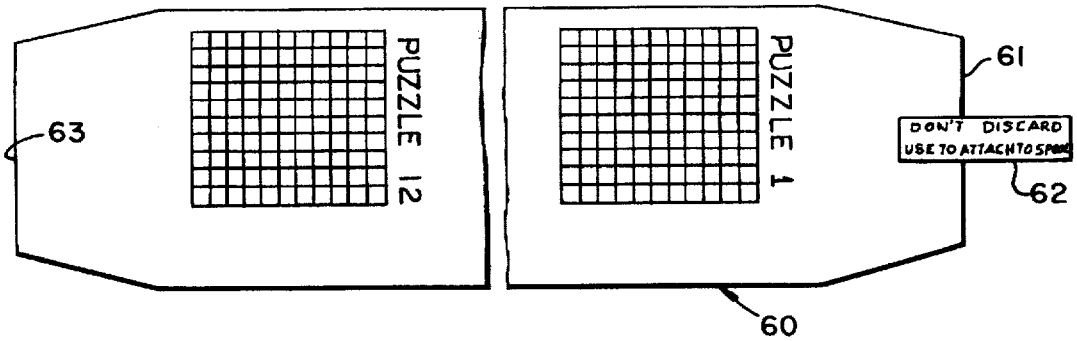
FIG. 9 shows inner and outer ends of the sheet seen in FIG. 8.

FIG. 9 shows opposite ends 61 and 63 of the game sheet, indicating that end 61 is closest to a first puzzle to be solved (labelled PUZZLE 1 in this figure) and end 63 (which is attached to the feed spool) is closest to a last puzzle to be solved (labelled PUZZLE 12 in this figure).

Figure 10:
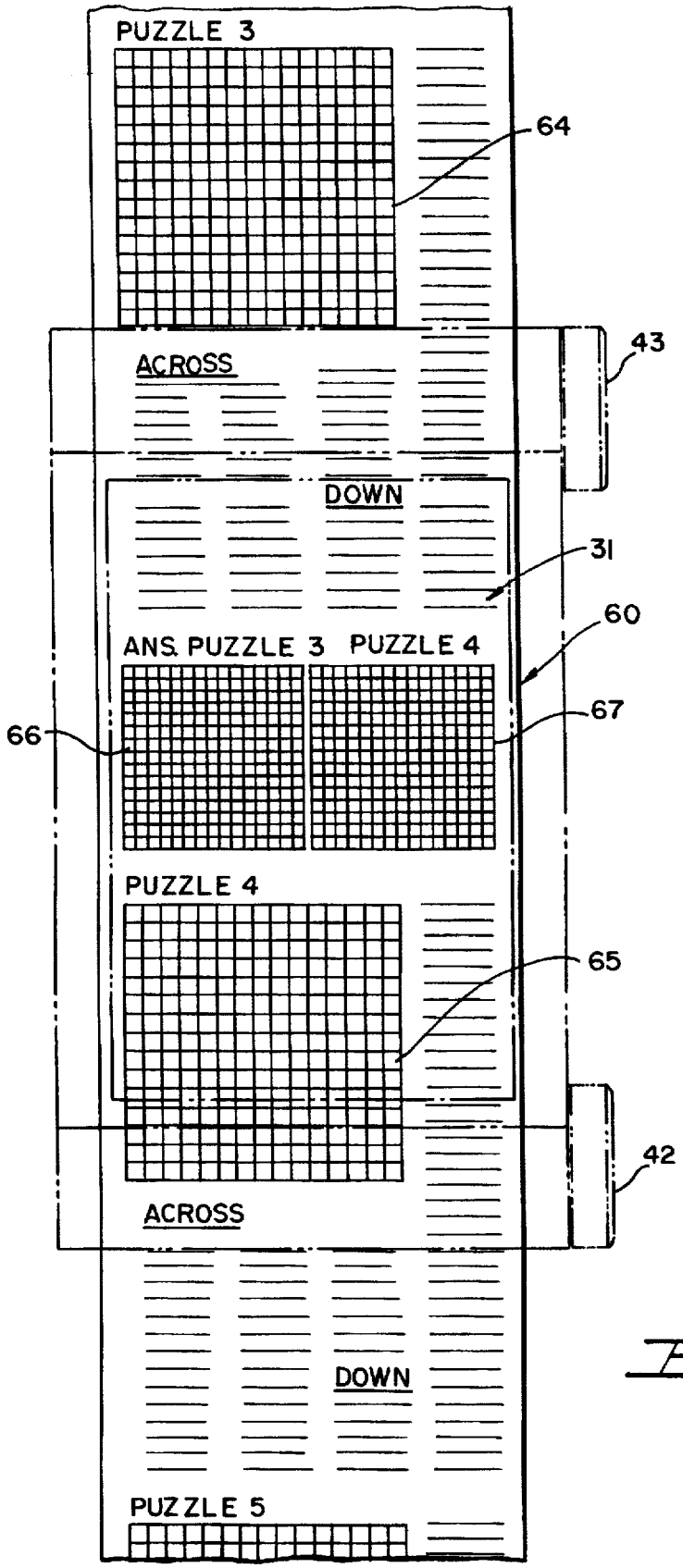
FIG. 10 is a view of a portion of the sheet seen in FIG. 8, showing relative positions on the sheet of puzzle games and pre-printed solutions to respective games.

A preferred arrangement of puzzle games and game solutions, on a sheet 60 containing a collection of games, is suggested in FIG. 10. As seen in this figure, solutions to a pair of games 64 and 65, which are respectively labelled "PUZZLE 3" and "PUZZLE 4", are printed respectively at 66 and 67 in the space between the two games. Cover window 31, seen in phantom in this figure, is dimensioned to permit viewing of only one game at a time, as well as to allow viewing of solutions of successive games, as a game sheet is moved relative to the window. As viewed in this figure, games 64 and 65 represent games which appear successively in window 31 as sheet 60 is unrolled from a feed spool in end compartment 22 (FIG. 1) onto a takeup spool in end compartment 23 (FIG. 1).

Thus, assuming that sheet 60 contains say 12 puzzle games consecutively labelled PUZZLE 1 through PUZZLE 12, solutions to each pair of successively appearing games (PUZZLE 1 and PUZZLE 2, PUZZLE 3 and PUZZLE 4, etc.) would be viewable in cover window 31, as the respective sheet is moved from a position in which the first game of a pair is viewable in the window to a position in which the second game of the same pair is viewable in the window. Consequently, a game player/user could compare his/her solution of a first appearing game of such a pair to the printed solution of that game, after solving that game (and while advancing the sheet to position the next game of the same pair in the window), and also could verify the correctness of his/her solution of the second game of a pair, by rotating dial 42 to move the sheet backwards towards end compartment 22.

Figure 7:
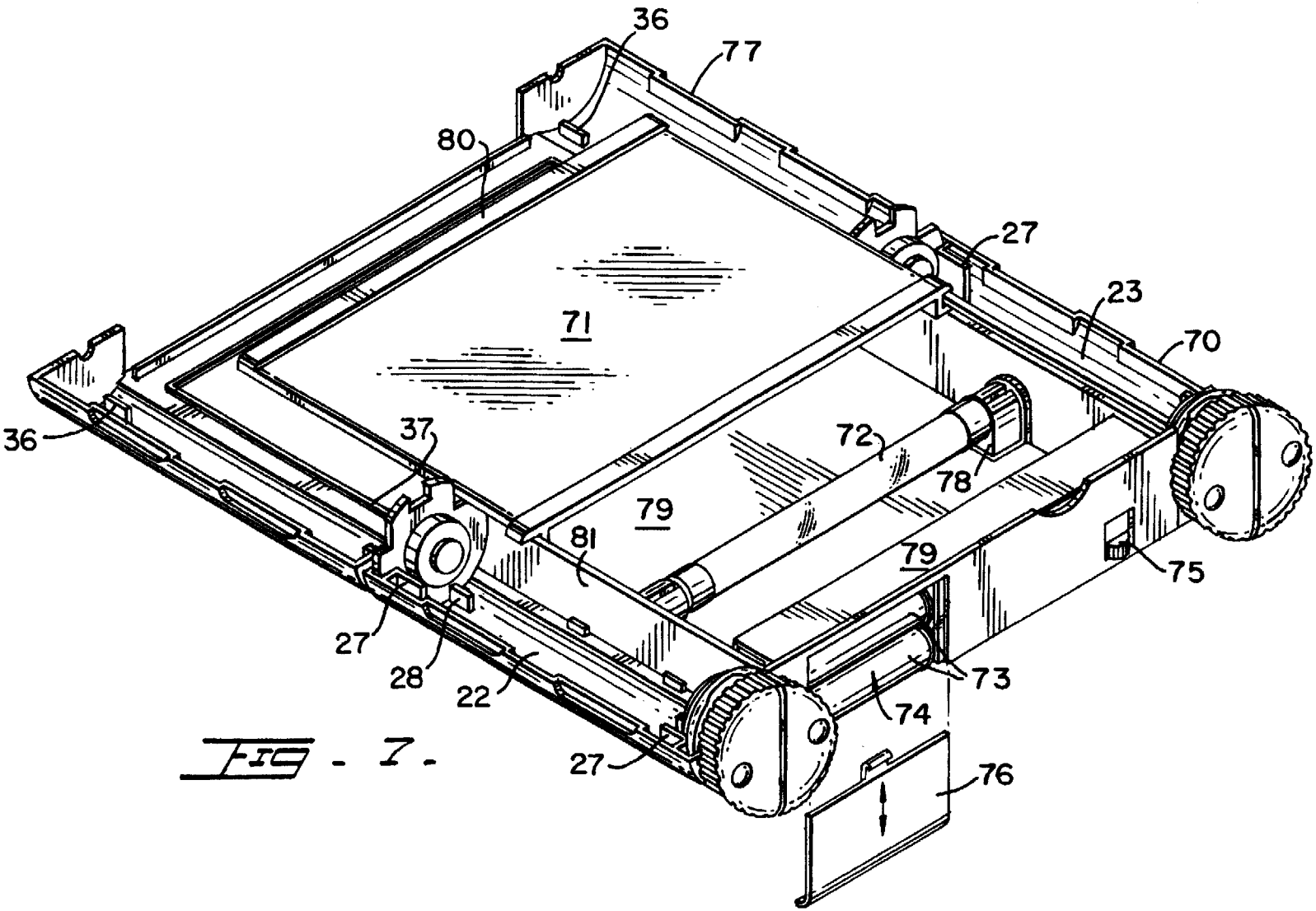
FIG. 7 is a perspective view of game holder apparatus in accordance with a second embodiment of the invention, showing a (translucent) platen element overlying a compartment containing a lamp, on/off switch, and battery.

FIG. 7 shows a second embodiment of the game holding assembly of this invention, with a base shown at 70. In this embodiment, the platen, shown at 71, is translucent and overlies a source of light (preferably a fluorescent bulb) 72. Light 72 is energized by one or more batteries 73, held in a battery compartment 74, through a circuit containing a switch 75. When the light is turned on, printed matter on a portion of a puzzle game sheet lying over the platen is uniformly illuminated, so that a game player can easily view such matter and solve respective puzzle games on the sheet while sitting or lying in a darkened room. Battery compartment 74 is covered by a cover 76 that is removable to permit replacement of the battery. Thus, in this second embodiment of the invention, the space beneath the platen is used exclusively for housing the light, battery and switch, whereas in the first embodiment of FIG. 1 the corresponding space holds storage drawer 53 seen in FIG. 4.

The cover portion of the holder in this embodiment is shown at 77. The cover is hinged to base 70 just as in the embodiment of FIG. 1. Platen 71 slides in the direction of hinge between the cover 77 and base 70 to allow access to light 72 (e.g. for replacement of a burned out bulb). In this figure, the platen is shown slid to its open position allowing access to the light 72 and its fixture 78.

Light 72 is located midway between long edges of the base in order to uniformly illuminate the platen and the portion of a game sheet that overlies the platen. Interior surfaces of base 70, beneath the light and on the vertical long sides of the base, are lined with a white reflective backing material (or coating) 79 that reflects light incident on the interior surfaces up through the platen. The lining material 79 is flexibly contoured over corners between the bottom interior surfaces and the side interior surfaces, in order to uniformly reflect light towards the platen.

Cover 77 in this embodiment is similar to the cover 30 shown in FIG. 1, except that the "strengthening ridge" indicated at 80, which resembles a similar ridge formation on cover 30, serves not only to reinforce the cover, along a relatively thin portion of it, but also to press against an edge of the platen 71 when the cover is closed. This serves to keep the (slidable) platen securely in place and also prevents light from passing out of the space between the platen and the base.

In this embodiment, the base 70 has only two inwardly projecting sets of tabs 27 and 29 (FIG. 7) similar to the triple set of tabs 27, 28 and 29 in base 20 discussed above in reference to FIG. 1. The cover 77 contains tabs 36 corresponding to the tabs 36 discussed earlier, and ridges 37 bordering its window opening that correspond to ridges 37 also discussed earlier. The cover tabs and ridges of this embodiment are essentially identical to respective tabs and ridges 36/37 discussed earlier. However, in the present embodiment, each end of each compartment 22 and 23 contains only two tabs extending from the bottom and an outer end of the base (distal from the platen) at the respective compartment end. A transverse wall 81 that supports the platen at the respective compartment serves as a third limiting stop associated with each respective set of two tabs and thus eliminating proximal tabs 29. The reason for this change in design is that the sliding platen of this embodiment is necessarily longer than the platen in the first embodiment in order to ensure adequate room for light 72 and fixture 78. Accordingly, it was necessary to move walls 81 supporting the platen in this embodiment lengthwise outward towards the ends of the base, and in doing so to eliminate the base tabs which in the first embodiment are situated nearest to the platen.

The foregoing and other features, aspects and functions of the present invention, may be further appreciated by considering the following claims.

We claim:

1. Portable game holder apparatus constituting a component of a portable game playing assembly, which assembly, when fully assembled, contains said holder apparatus, a writable game sheet, and a pair of identical rollers on which said game sheet is partially wound during play and between which said game sheet is movable during play; said pair of rollers consisting of a supply roller, on which said game sheet is initially fully wound, and a take-up roller to which said game sheet is transferred as games thereon are played; said holder apparatus constituting a reusable portion of said game playing assembly and said game sheet and rollers constituting discardable and replaceable portions of said game playing assembly; said game sheet containing a collection of multiple pre-printed games to be played by a user of said game playing assembly; said game playing assembly, when fully assembled, being useful for displaying portions of a said game sheet containing individual games to be played by a said user of said game playing assembly; said user using said assembly to view a said displayed portion of said game sheet, to write upon the respective viewed portion using said holder apparatus to provide backing support for the respective viewed portion permitting writing thereon, and thereafter to incrementally move said game sheet between said supply and take-up rollers to display another portion of said sheet containing a new game to be played; said game holder apparatus comprising:

separable base and cover components forming an enclosure for removably holding a said pair of supply and take-up rollers and a said game sheet to be transported between said pair of rollers; said cover containing a viewing window dimensioned to frame an area filled by a single game in a said collection of games pre-printed on said sheet, said cover and base comprising elements forming:

first and second holding compartments formed to respectively receive and hold said supply and take-up rollers of a said pair of rollers, and a said game sheet initially wound on said supply roller of said pair of rollers; and said base containing a flat solidly formed platen extending between said first and second holding compartments; said platen spanning the space framed by said cover viewing window, said platen forming a supporting structure for enabling a said game player to write upon a portion of a said sheet appearing in said viewing window when a said pair of rollers and portions of the respective sheet are held in said first and second compartments; and thereby enabling said game player to solve a puzzle game currently framed in said cover window; and said platen further containing upraised guide ridges for maintaining a said game sheet in alignment with said rollers in said first and second holding compartments while the respective sheet is being moved between said rollers in said compartments.

2. Game holder apparatus in accordance with claim 1 further including front and rear dial assemblies rotatably mounted on said base portion respectively adjacent to said front and rear compartments; said dial assemblies extending between the interior and exterior of said enclosure formed by said base and cover, and being formed to rotatably engage a said pair of supply and take-up rollers when the respective pair of supply and take-up rollers are respectively held in said first and second compartments: said dial assemblies being manually rotatable, by a game player using said holder apparatus as a said component of a said game playing apparatus, to move said game sheet incrementally between said rollers in said first and second compartments and thereby position individual games, in a said collection of multiple games successively printed on said sheet, into viewing position relative to said cover viewing windows.

3. Game holder apparatus in accordance with claim 1 wherein said cover is hinged to said base, and said cover is pivotable to open and closed positions relative to said base; said cover and base, in said closed position forming said first and second holding compartments; said cover in said open position permitting access to said holding compartments for removal of a used game sheet and take-up roller, and insertion of a new game sheet and supply roller.

4. Portable game holder apparatus constituting a reusable component of a game playing assembly having discardable and replaceable parts, said discardable and replaceable parts including a game sheet and a pair of identical rollers on which said game sheet is wound and between which said game sheet is moved during use of said playing assembly, said sheet containing a collection of multiple printed games to be played by a game player using said game playing assembly, wherein playing said games entails having said game player write directly on said game sheet while it is held in said playing assembly, said game holder apparatus comprising:

separable base and cover components forming an enclosure for holding and displaying a said game sheet; said cover component containing a viewing window dimensioned to frame an area filled by a single game in a said collection of games, said cover and base components having shaped elements forming:

first and second holding compartments formed to receive and hold a said pair of identical rollers and a said game sheet that is wound initially on one roller of said pair of rollers, and that is movable between said compartments during play to be unwound from said one roller of said pair and wound upon the other roller of said pair; and said base component containing a flat solidly formed platen extending between said first and second holding compartments; said platen spanning the space framed by said window in said cover component and providing a backing surface for enabling a said game player to write upon a said game sheet contained in said playing assembly and thereby play a game framed in said cover component window; and wherein said platen is translucent, and said base component contains a source of light beneath said platen for illuminating a game printed on a portion of said game sheet overlying said platen.

5. Game holder apparatus in accordance with claim 4 wherein said base component supports an on/off switch which can be operated by a said game player to electrically energize and deenergize said source of light.

6. Game holder apparatus in accordance with claim 1 wherein said base component contains a drawer slidably mounted beneath said platen; said drawer being useful to store objects used by said game player.

7. Game holder apparatus in accordance with claim 4 wherein said platen contains upraised guide ridges forming guiding elements for maintaining a said game sheet in predetermined alignment with said first and second holding compartments, during movement of the respective game sheet between said compartments.

8. Game holder apparatus in accordance with either of claims 1 and 4 comprising dial assemblies mounted on said base component adjacent to portions of said base component forming said first and second holding compartments, said dial assemblies being useful for engaging and rotating a said pair of rollers held in said compartments when said game playing assembly is fully assembled; and wherein each said dial assembly comprises:

a fixed plate-like formation integral to said base component, said fixed plate-like formation having an opening therein;

a manually operated dial member located external to said base component, said dial member having a shaft-like portion extending through said opening in said fixed plate-like formation into the interior of said base component; said dial member and its shaft-like portion being rotatably supported in said opening; and means attached to said shaft-like portion of said dial member, within said interior of said base component, for retaining said dial member in rotatable engagement with said plate-like formation while permitting said shaft-like portion of said dial member to be disengaged from said plate-like formation when the dial member is manually moved linearly outward relative to the exterior of said base component; said shaft-like portion of said dial member, when rotatably engaged with said plate-like formation, serving to securely hold a said roller removably contained within one of said compartments adjacent to the respective dial assembly permit said plate-like formation to impart rotation to the respective roller and thereby permit a said game sheet to be moved across said platen and wound upon the respective roller; said shaft-like portion and said plate-like formation, when rotatably disengaged, permitting a said roller to be inserted into and removed from said adjacent compartment.

9. Game holder apparatus in accordance with either of claims 1 and 4, wherein said cover and base components contain mating elevations and indentations serving to forcibly secure said cover component in latched engagement with said base component.

10. Game holder apparatus in accordance with claim 4 wherein a portion of said cover component that is movable into and out of contact with said base component is thinner than other portions of said cover component, and wherein said thinner portion is reinforced by a strengthening ridge construction along the length thereof.

11. Game holder apparatus in accordance with either of claims 1 and 4, wherein said base contains a set of at least two tabs at each end of each of said first and second compartments, said set of tabs at each said end serving as limit stops relative to said rollers when a said pair of rollers is housed in said first and second compartments.

12. Portable game holder apparatus constituting a reusable component of a game playing assembly having other parts that are discardable and replaceable, said other parts including a game sheet and a pair of identical rollers that are used as supply and take-up rollers when the game playing assembly is fully assembled and in use, said game sheet being initially wound upon the said supply roller of said pair of rollers when said game playing assembly is initially prepared for use, said game sheet containing a series of multiple printed games to be played by a user of said game playing assembly, said game holder apparatus comprising:

a first compartment for holding a removable and replaceable supply roller constituting a supply roller of a said pair of rollers initially containing a said game sheet wound thereon;

a second compartment for holding a removable and replaceable takeup roller constituting another roller of said pair of rollers, said take-up roller, when used in said game playing assembly, being attachable to a starting end of said game sheet nearest to a first game in said series of games;

a lighting compartment located between said first and second compartments; said lighting compartment containing a controllably energizable source of light;

a translucent platen element overlying said lighting compartment; said platen element providing a backing surface, for a portion of said game sheet overlying said platen element when said game playing assembly is fully assembled and in use, said backing surface enabling a game player to play a game contained on said overlying portion of said sheet by writing on said overlying portion of said sheet; said platen element also transferring light from said energizable source of light for illuminating said overlying portion of said game sheet so that a game contained upon said portion is clearly viewable in a darkened environment; and a rotating dial assembly coupled to at least one of said first and second compartments for enabling a said game player to move said game sheet between said supply and takeup rollers that are contained in said first and second compartments, when said game playing assembly is assembled and in use, in order to position portions of said sheet containing different games of said series of games over said translucent platen element.

13. Game holder apparatus in accordance with claim 12 wherein:

said energizable source of light is centrally positioned in said lighting compartment, and surfaces of said lighting compartment are covered with reflective material causing light passing from said source to said material to be uniformly directed to said platen element and uniformly applied to said portion of said game sheet overlying said platen element.

14. Game holder apparatus in accordance with claim 12 wherein:

said platen element is movable relative to said lighting compartment to allow for replacement of said energizable source of light.

15. Game holder apparatus in accordance with claim 14 including:

means for securely but releasably holding said platen element in a predetermined position over said lighting compartment while said apparatus is either being used or transported by a said game player.

16. Game holder apparatus in accordance with claim 15 wherein said means for securely but releasably holding said platen element is effective to prevent light from escaping from said lighting compartment without first passing through said platen element.

17. Game holder apparatus in accordance with claim 12 wherein:

said lighting compartment consists of first and second walls supporting opposite ends of said platen;

said first and second holding compartments are separated from said lighting compartment by said first and second walls; and each said holding compartment contains at each end thereof a set of two tabs extending inwardly from interior surfaces of the respective compartment; each said set of two tabs, together with the respective one of said first and second walls that separates the respective holding compartment from said lighting compartment, forming limit stops for securely retaining a respective one of said supply and takeup rollers within the respective holding compartment when said game playing assembly is fully assembled and in use.

18. A game playing assembly for holding and dispensing a consumable and replaceable game playing element;

said game playing element comprising a writeable medium containing a plurality of pre-printed games requiring a user of said assembly to write on said writeable medium; said game playing assembly comprising:

a) first and second separable cover elements forming an enclosure for said game playing element; said enclosure containing discretely separate but identically formed first and second holding compartments for dispensing and collecting portions of said game playing element;

b) a backing element securely held within said enclosure, between said first and second compartments, for supporting a portion of a said game playing element in a manner enabling a said user of said assembly to write on said supported portion;

c) an opening in one of said first and second elements allowing a user to view and write directly upon said supported portion of a said game playing element in order to play a game contained on and viewable on said supported portion; and d) means communicating with said first and second holding compartments for enabling a said user to manually alter the position of a said game playing element relative to said opening in said one of said elements, without opening said enclosure, so as to present any selected one of said plurality of games to be viewed and played through said opening in said one of said elements.

* * * * *